US011987426B2

(12) United States Patent
Filippini et al.

(10) Patent No.: US 11,987,426 B2
(45) Date of Patent: May 21, 2024

(54) LID-SPOUT ASSEMBLY FOR A PACKAGE AND PACKAGE HAVING A LID-SPOUT ASSEMBLY

(71) Applicant: Tetra Laval Holdings & Finance S.A., Pully (CH)

(72) Inventors: Maurizio Filippini, Modena (IT); Francesca Tavoni, Modena (IT)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 17/923,581

(22) PCT Filed: May 21, 2021

(86) PCT No.: PCT/EP2021/063624
§ 371 (c)(1),
(2) Date: Nov. 6, 2022

(87) PCT Pub. No.: WO2021/239609
PCT Pub. Date: Dec. 2, 2021

(65) Prior Publication Data

US 2023/0182971 A1 Jun. 15, 2023

(30) Foreign Application Priority Data

May 27, 2020 (EP) ..... 20176808

(51) Int. Cl.
*B65D 5/74* (2006.01)
*B65D 47/14* (2006.01)

(52) U.S. Cl.
CPC ..... *B65D 47/141* (2013.01); *B65D 5/746* (2013.01)

(58) Field of Classification Search
CPC ..... B65D 5/746; B65D 5/563; B65D 47/103; B65D 47/0847; B65D 2401/15; B29C 66/53247
(Continued)

(56) References Cited

U.S. PATENT DOCUMENTS 3,282,477 A * 11/1966 Henchert ..... B65D 47/148 222/541.9
3,434,620 A * 3/1969 Laurizio ..... B65D 47/103 222/541.9
(Continued)

FOREIGN PATENT DOCUMENTS

EP 3590856 A1 1/2020
EP 3590857 A1 1/2020
(Continued)

OTHER PUBLICATIONS

International Search Report mailed Aug. 19, 2021, for priority International Patent Application No. PCT/EP2021/063624.
(Continued)

*Primary Examiner* — Charles P. Cheyney
(74) *Attorney, Agent, or Firm* — Renner, Otto, Boisselle & Sklar, LLP

(57) ABSTRACT

A lid-spout assembly for a package having a main body including a designated pour opening and being filled with a pourable product. The lid-spout assembly comprises at least a spout having a pouring outlet, a lid configured to selectively close and open the pouring outlet and a tethering element tethering the lid to the spout. The spout includes at least a base frame configured to couple the spout to the main body about the designated pour opening and a collar carrying the pouring outlet and protruding from the base frame. The tethering element includes a first end fixed to the lid and a second end fixed to the collar.

15 Claims, 4 Drawing Sheets

(58) Field of Classification Search
USPC ..... 222/541.9, 556, 541.5, 566; 220/258.2, 220/258.5, 375
See application file for complete search history.

(56) References Cited

U.S. PATENT DOCUMENTS 4,775,098 A * 10/1988 Peer, Jr. ..... B65D 5/708 229/125.17
4,795,065 A * 1/1989 Ashizawa ..... B65D 47/0838 220/832
4,986,465 A * 1/1991 Jacobsson ..... B65D 5/727 229/125.09
5,065,938 A * 11/1991 Anderson ..... B65D 5/746 229/125.15
5,101,999 A * 4/1992 Robichaud ..... B65D 5/748 220/267
5,484,101 A * 1/1996 Hedberg ..... B65D 5/746 220/255
5,799,840 A * 9/1998 Mogard ..... B65D 47/0842 222/541.9
5,934,496 A * 8/1999 Mogard ..... B65B 7/2878 220/837
6,454,161 B1 * 9/2002 Rendina ..... B65D 5/746 220/276
6,554,181 B1 * 4/2003 Dammers ..... B65D 5/748 220/267
6,626,315 B2 * 9/2003 Lees ..... B65B 3/025 229/125.09

FOREIGN PATENT DOCUMENTS

GB 2233315 A 1/1991
KR 20030023685 A 3/2003

OTHER PUBLICATIONS

Communication pursuant to Article 94(3) EPC dated May 10, 2023, for corresponding European Patent Application No. 21175221.7.

* cited by examiner

LID-SPOUT ASSEMBLY FOR A PACKAGE AND PACKAGE HAVING A LID-SPOUT ASSEMBLY

TECHNICAL FIELD

The present invention relates to a lid-spout assembly for a package, in particular a package having a sealed main body, filled with a pourable product, even more particular filled with a pourable food product.

Advantageously, the present invention also relates to a package, in particular a package having a sealed main body, filled with a pourable product, even more particular filled with a pourable food product, and comprising a lid-spout assembly.

BACKGROUND ART

As is known, many liquid or pourable food products, such as fruit juice, UHT (ultra-high-temperature treated) milk, wine, tomato sauce, etc., are sold in packages, in particular sealed packages, made of sterilized packaging material.

A typical example is the parallelepiped-shaped package for pourable food products known as Tetra Brik Aseptic (registered trademark), which is made by sealing and folding a laminated strip packaging material. The packaging material has a multilayer structure comprising a carton and/or paper base layer, covered on both sides with layers of heat-seal plastic material, e.g. polyethylene. In the case of aseptic packages for long-storage products, the packaging material also comprises a layer of oxygen-barrier material, e.g. an aluminum foil, which is superimposed on a layer of heat-seal plastic material, and is in turn covered with another layer of heat-seal plastic material forming the inner face of the package eventually contacting the food product.

Some of the known packages are designed for the consumption on-the-go, i.e. the package is provided with means which allow a consumer to consume the pourable product without the need to pour the pourable product into another container such as a drinking glass or a drinking cup prior to its consumption.

One of the known means may be a straw, which is to be introduced into a main body of the package, the main body containing the pourable product. Prior to its use, the straw is wrapped within an envelope, which typically is attached together with the straw to the main body. Thus, prior to a first-time use, the straw has to be extracted from the envelope. A drawback of such packages is seen in that the presence of a straw and its envelope may lead to an unwanted or undesired littering of the envelope and/or the straw.

Alternative solutions are described in the European patent applications EP-A-3590856 and EP-A-3590857 by the same Applicant. Both European patent applications describe respective packages resolving the inconveniences related to the packages being provided with straws and their envelopes. Each one of the packages disclosed in the above-mentioned European patent applications comprises a sealed main body having a designated pour opening and a lid-spout assembly arranged on the main body about the designated pour opening and configured to allow for a controlled outpouring of the pourable product so that the consumer can consume the pourable product directly from the package.

Each lid-spout assembly comprises a spout having a pouring outlet and a lid removably coupled to the spout so as to selectively close and open the pouring outlet.

The spout comprises a base frame for coupling the spout to the main body about the designated pour opening and a collar carrying the pouring outlet and protruding from the base frame.

In order to avoid any unwanted littering of the lid, the lid-spout assembly also comprises a tethering element connecting the lid and the spout with one another. In particular, the tethering element is fixed to the lid and the base frame.

The tethering element adopts different shapes in dependence of whether the lid closes or opens the pouring outlet, i.e. whether the lid is a closed position or in an open position.

The lid-spout assembly also comprises a retaining group so as to allow to define a precise and stable position when the lid opens the pouring outlet, i.e. when the lid is in the open position.

Even though such lid-spout assemblies work satisfyingly well, a desire is felt in the sector to further improve such lid-spout assemblies, in particular so as to ensure that the lid remains coupled to the spout by means of the tethering element, even in the case of significant separation forces acting on the tethering element and/or to reduce the stress on the tethering element when the lid is arranged in the open position, in particular when interacting with the retaining group.

DISCLOSURE OF INVENTION

It is therefore an object of the present invention to provide in a straightforward and low-cost manner an improved lid-spout assembly for a package, in particular a package having a sealed main body, filled with a pourable product, even more particular filled with a pourable food product.

In particular, it is an object of the present invention to provide in a straightforward and low-cost manner an improved lid-spout assembly for a package, in particular a package having a sealed main body, filled with a pourable product, even more particular filled with a pourable food product, which ensures the permanent coupling of the lid of the lid-spout assembly to the spout of the lid spout assembly and/or such that the tethering elements is subjected to reduced stresses when the lid opens the pouring outlet, i.e. when the lid is in the open position.

It is a further object of the present invention to provide in a straightforward and low-cost manner a package, in particular a package having a sealed main body, filled with a pourable product, in particular filled with a pourable food product, having a lid-spout assembly, in particular the lid-spout assembly being designed to ensure the permanent coupling of the lid of the lid-spout assembly to the spout of the lid-spout assembly and/or such that the tethering elements is subjected to reduced stresses when the lid opens the pouring outlet, i.e. when the lid is in the open position.

According to the present invention, there is provided a lid-spout assembly according to the independent claim.

Further advantageous embodiments of the lid-spout assembly are specified in the respective dependent claims.

According to the present invention, there is also provided a package according to any one of claims 16 and 17.

BRIEF DESCRIPTION OF THE DRAWINGS

A non-limiting embodiment of the present invention will be described by way of example with reference to the accompanying drawings, in which.

BEST MODES FOR CARRYING OUT THE INVENTION

Number 1 indicates as a whole a package comprising:

- a (sealed) main body 2, in particular a sealed carton body, being filled with a pourable product, in particular a pourable food product, and having a designated pour opening (not shown and known as such) configured to allow for an outflow of the pourable product from main body 2; and
- a lid-spout assembly 3 coupled to main body 2 arranged and/or arrangeable about the designated pour opening and configured to allow for a controlled outpouring of the pourable product from main body 2, in particular so that a consumer can consume the pourable product directly through lid-spout assembly 3 and/or from package 1.

Preferentially, package 1 is designed for the consumption on-the-go, i.e. the consumer can consume the pourable product directly from package 1 without the need of any intermediate means such as drinking glasses, drinking cups or similar.

Preferentially, lid-spout assembly 3 is designed for the consumption on-the-go, i.e. the consumer can consume the pourable product directly through lid-spout assembly 3.

According to some preferred non-limiting embodiments, main body 2 is obtained from a packaging material, in particular a composite packaging material, having a multi-layer structure (not shown and known as such).

Preferentially, the packaging material is provided in the form of a web.

Preferentially, main body 2 is obtained by forming a tube from the packaging material, longitudinally sealing the tube, filling the tube with the pourable product and by transversally sealing and cutting the tube.

Preferentially, the packaging material comprises at least one layer of fibrous material, such as e.g. paper or cardboard, and at least two layers of heat-seal plastic material, e.g. polyethylene, interposing the layer of fibrous material in between one another. One of these two layers of heat-seal plastic material defining the inner face of main body 2 contacting the pourable product.

Preferably, the packaging material also comprises a layer of gas- and light-barrier material, e.g. aluminum foil or ethylene vinyl alcohol (EVOH) film, in particular being arranged between one of the layers of the heat-seal plastic material and the layer of fibrous material. Preferentially, the packaging material also comprises a further layer of heat-seal plastic material being interposed between the layer of gas- and light-barrier material and the layer of fibrous material.

According to some non-limiting embodiments, lid-spout assembly(ies) 3 is/are applied to the packaging material prior to arranging the packaging material within or during advancement of the packaging material through a packaging machine for forming, filling and sealing main bodies 2 from the packaging material carrying lid-spout assembly(ies) 3.

In particular, application of lid-spout assembly(ies) 3 to the packaging material occurs by means of a molding process and/or adhesive bonding and/or ultrasonic bonding.

Figure 1B:
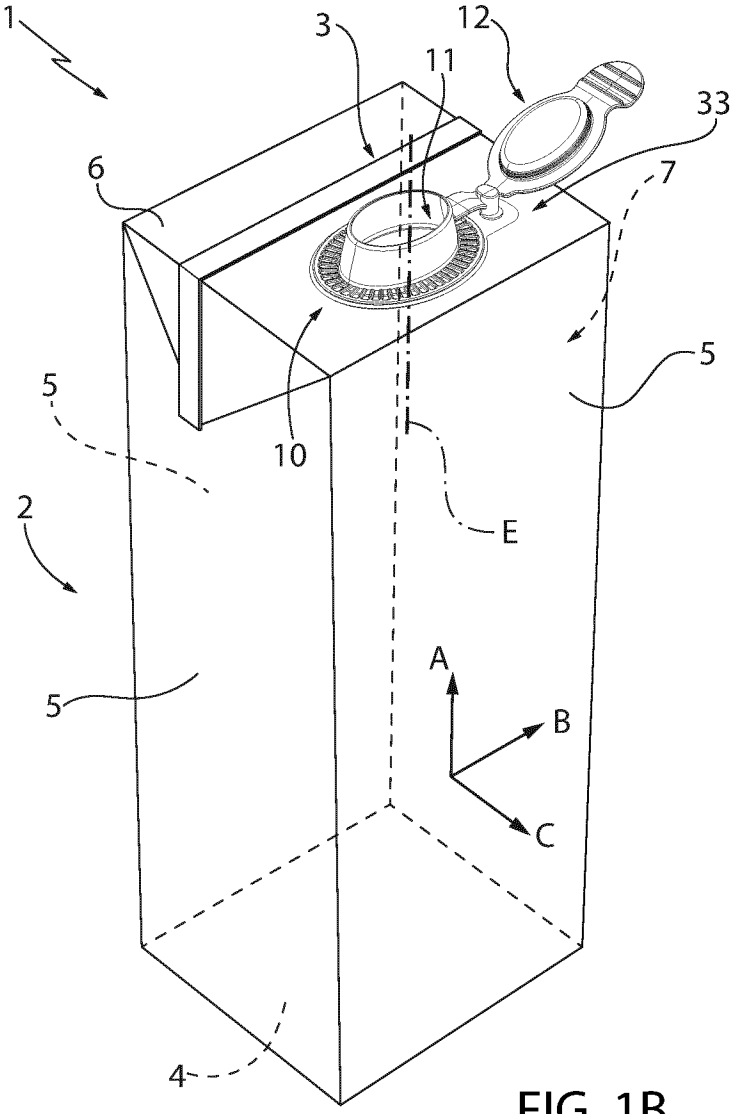
FIG. 1B is a schematic perspective view of the package of FIG. 1A with the lid-spout assembly being in a second configuration, with parts removed for clarity.
Figure 1A:
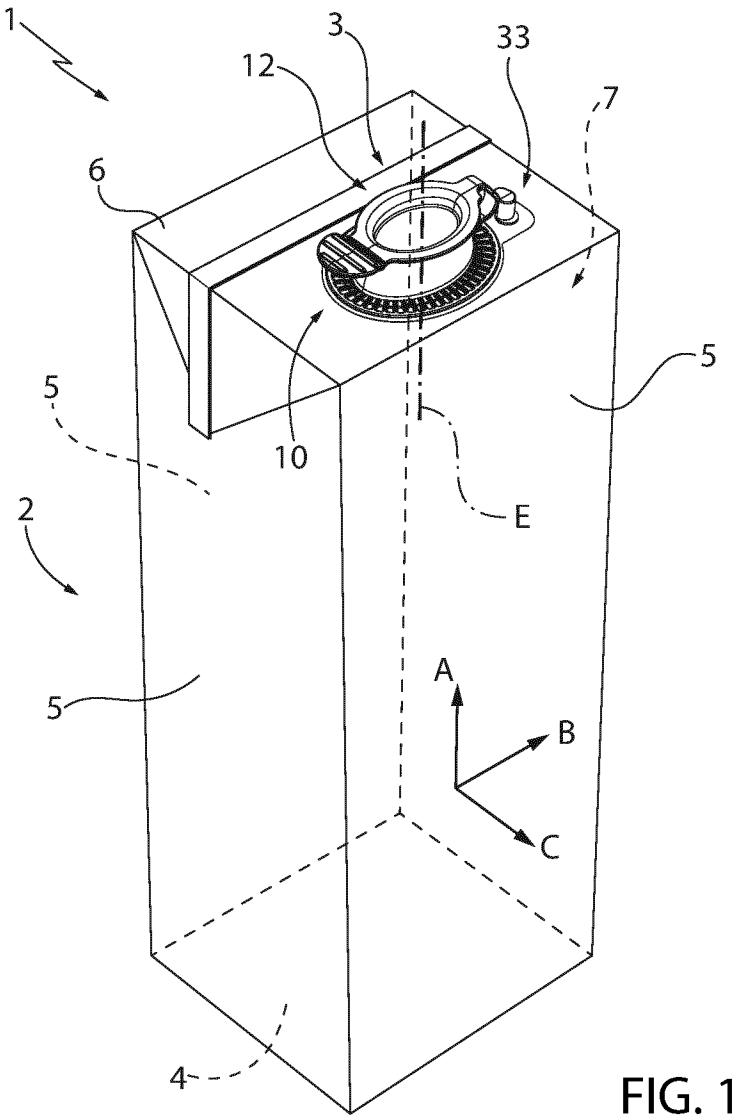
FIG. 1A is a schematic perspective view of a package having a lid-spout assembly according to the present invention and being in a first configuration, with parts removed for clarity.
Figure 2:
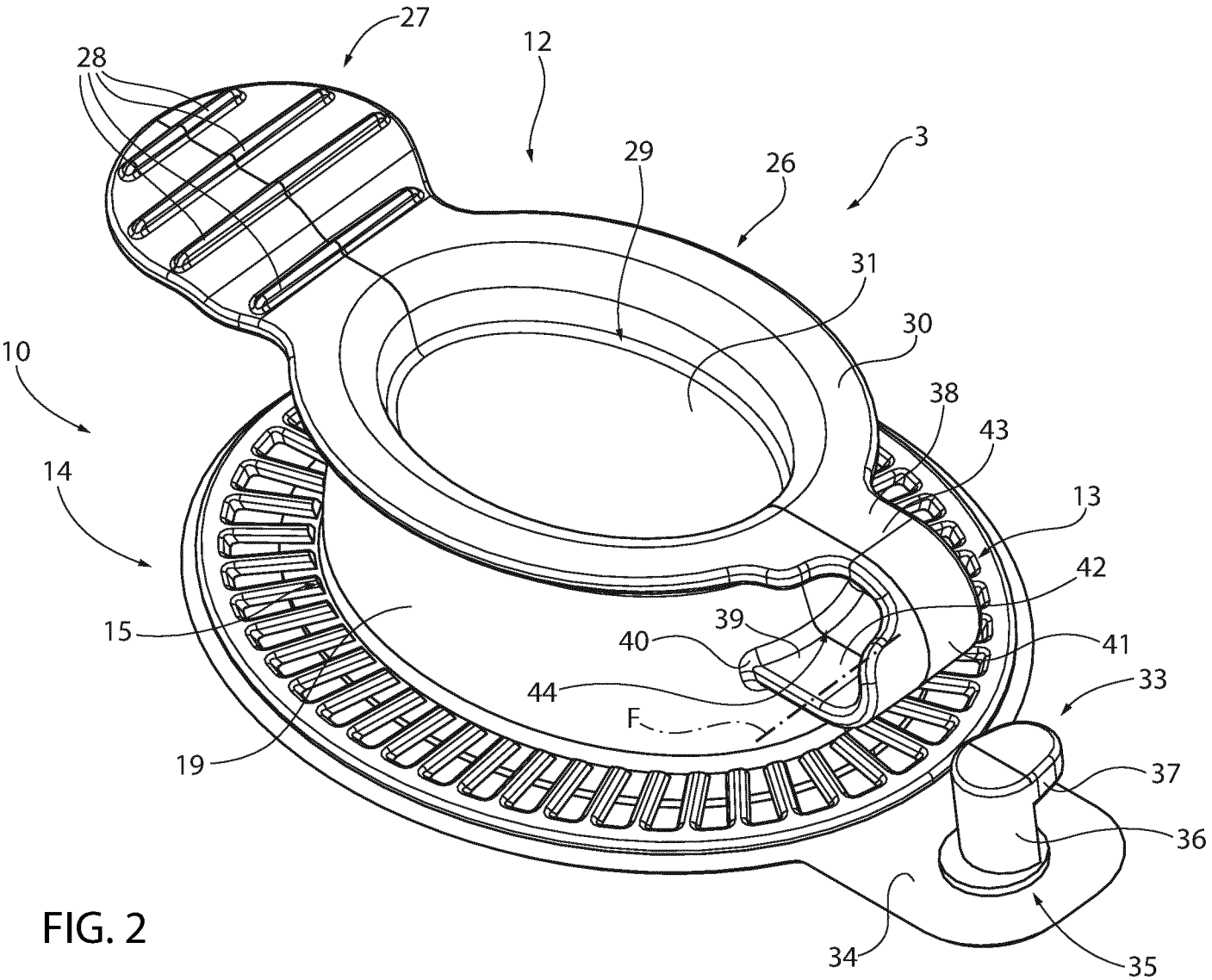
FIG. 2 is an enlarged perspective view of the lid-spout assembly being in the first configuration, with parts removed for clarity.

With particular reference to FIGS. 1A and 1B, main body 2 extends along a longitudinal axis A, a first transversal axis B and a second transversal axis C. In particular, the extension of package 2 along longitudinal axis A is larger than the extension of package 2 along first transversal axis B and second transversal axis C.

Preferentially, main body 2 is parallelepiped-shaped.

According to some preferred non-limiting embodiments, main body 2 comprises a first wall portion 4, in particular being transversal, even more particular perpendicular, to longitudinal axis A, from which main body 2 extends along longitudinal axis A. Preferably, first wall portion 4 defines a support surface of package 1, in particular of main body 2, which is designed to be put in contact with a support, such as e.g. a shelf, when, in use, being e.g. exposed within a sales point or when being stored. In particular, when being arranged on a support first wall portion 4 defines a bottom wall portion.

Preferably, main body 2 also comprises a plurality of lateral walls 5 being (fixedly) connected to first wall portion 4 and extending, in particular substantially parallel to longitudinal axis A, from first wall portion 4.

Preferably, main body 2 also comprises a second wall portion 6 opposite to first wall portion 4 and being (fixedly) connected to at least some of lateral walls 5. In particular, lateral walls 5 are interposed between first wall portion 4 and second wall portion 6. In particular, when main body 2 is arranged on a support, second wall portion 6 defines a top wall portion.

According to some non-limiting embodiments, first wall portion 4 and second wall portion 6 may be parallel to one another.

According to a non-limiting alternative embodiment not shown, first wall portion 4 and second wall portion 6 could be inclined with respect to one another.

According to some non-limiting embodiments, second wall portion 6 carries and/or comprises the designated pour opening.

According to some preferred non-limiting embodiments, package 1, in particular main body 2, comprises an inner space 7 configured to contain and/or containing the pourable product. In particular, at least first wall portion 4, lateral walls 5 and second wall portion 6 delimit inner space 7.

With particular reference to FIGS. 1A to 5, lid-spout assembly 3 comprises at least:

- a spout 10 being connected or being connectable to main body 2 about the designated pour opening and having a pouring outlet 11 configured to allow for a (controlled) outflow of the pourable product from spout 10 itself (and main body 2 and/or package 1);
- a lid 12 coupled to spout 10 and configured to selectively close and open pouring outlet 11; and
- a tethering element 13 (permanently) tethering and/or coupling lid 12 to spout 10.

In more detail and with particular reference to FIGS. 1A to 5, spout 10 comprises at least:

a base frame 14 coupling and/or configured to couple spout 10 to main body 2, in particular to second wall portion 6, about the designated pour opening; and a collar 15 carrying (comprising) pouring outlet 11 and being fixed to base frame 14 and protruding from base frame 14.

Preferentially, collar 15 extends along a longitudinal axis E, in particular transversal, even more particular perpendicular to second wall portion 6, and carries (comprises) pouring outlet 11 at a first axial end of collar 15 itself, and in particular an inlet opening 16 for the pourable product at a second axial end of collar 15 itself opposite to the first axial end.

Preferentially, collar 15 delimits (and/or comprises) a flow channel 17 for the pourable product, in particular extending between inlet opening 16 and pouring outlet 11. In use, collar 15 is configured such to receive the pourable product from inner space 7 through inlet opening 16 and such that the pourable product flows out of pouring outlet 11.

Preferentially, collar 15 comprises an inner surface 18 delimiting flow channel 17 and an outer surface 19 opposite to inner surface 18.

Preferentially, collar 15 has a tubular configuration.

Preferentially, collar 15 has an annular cross-sectional profile with respect to a cross-sectional plane perpendicular to longitudinal axis E. In particular, the cross-sectional profile has an oval shape. Alternatively, the cross-sectional profile could have a circular or square or elliptical or rectangular shape.

Preferentially, collar 15 comprises a first rim 20 delimiting pouring outlet 11, and in particular a second rim opposite to first rim 20 and delimiting inlet opening 16. In particular, first rim 20 is arranged at the first axial end of collar 15 and the second rim is arranged at the second axial end of collar 15.

In particular, first rim 20, even more particular also the second rim, has/have a respective oval shape. Alternatively, first rim 20 and/or the second rim could have a square and/or a rectangular and/or an elliptical and/or circular shape.

According to some preferred non-limiting embodiments, collar 15, in particular first rim 20, is designed such to allow a consumer to drink from spout 10, in particular collar 15.

Preferentially, collar 15 is shaped such to facilitate the outflow of the pourable product from collar 15 itself.

Figure 3:
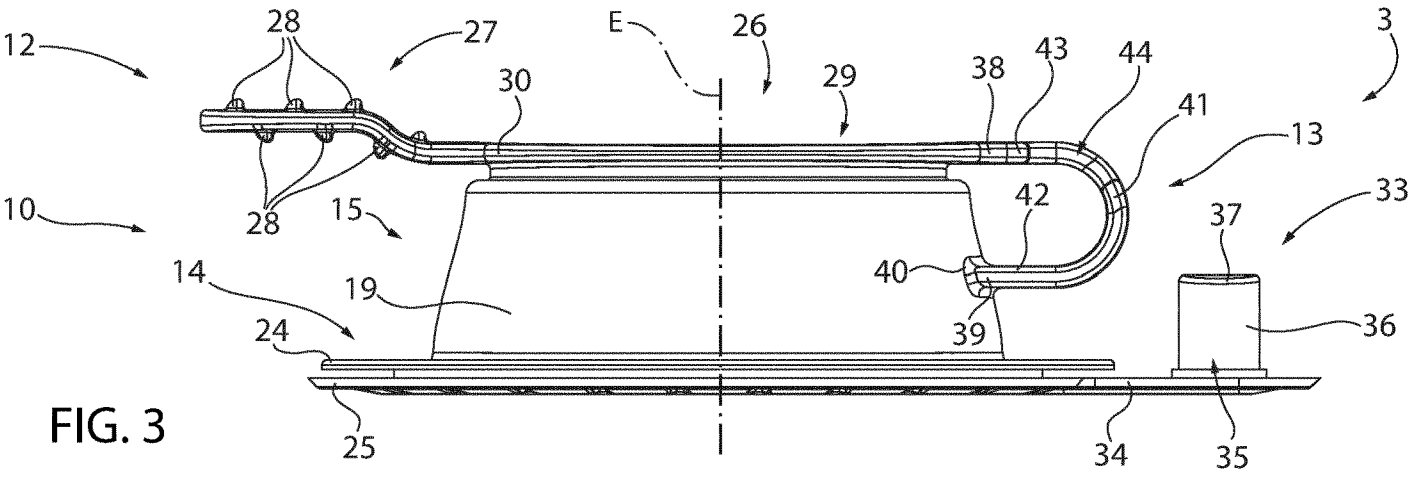
FIG. 3 is an enlarged side-view of the lid-spout assembly being in the first configuration, with parts removed for clarity.
Figure 4:
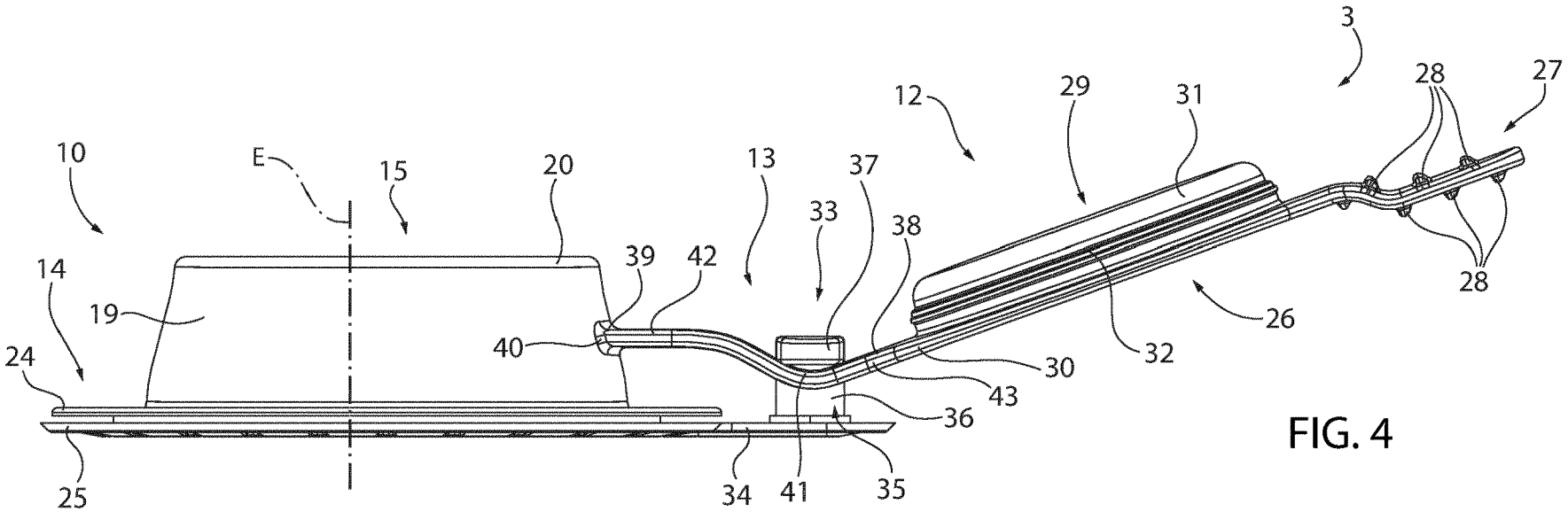
FIG. 4 is an enlarged side-view of the lid-spout assembly being in the second configuration, with parts removed for clarity.
Figure 5:
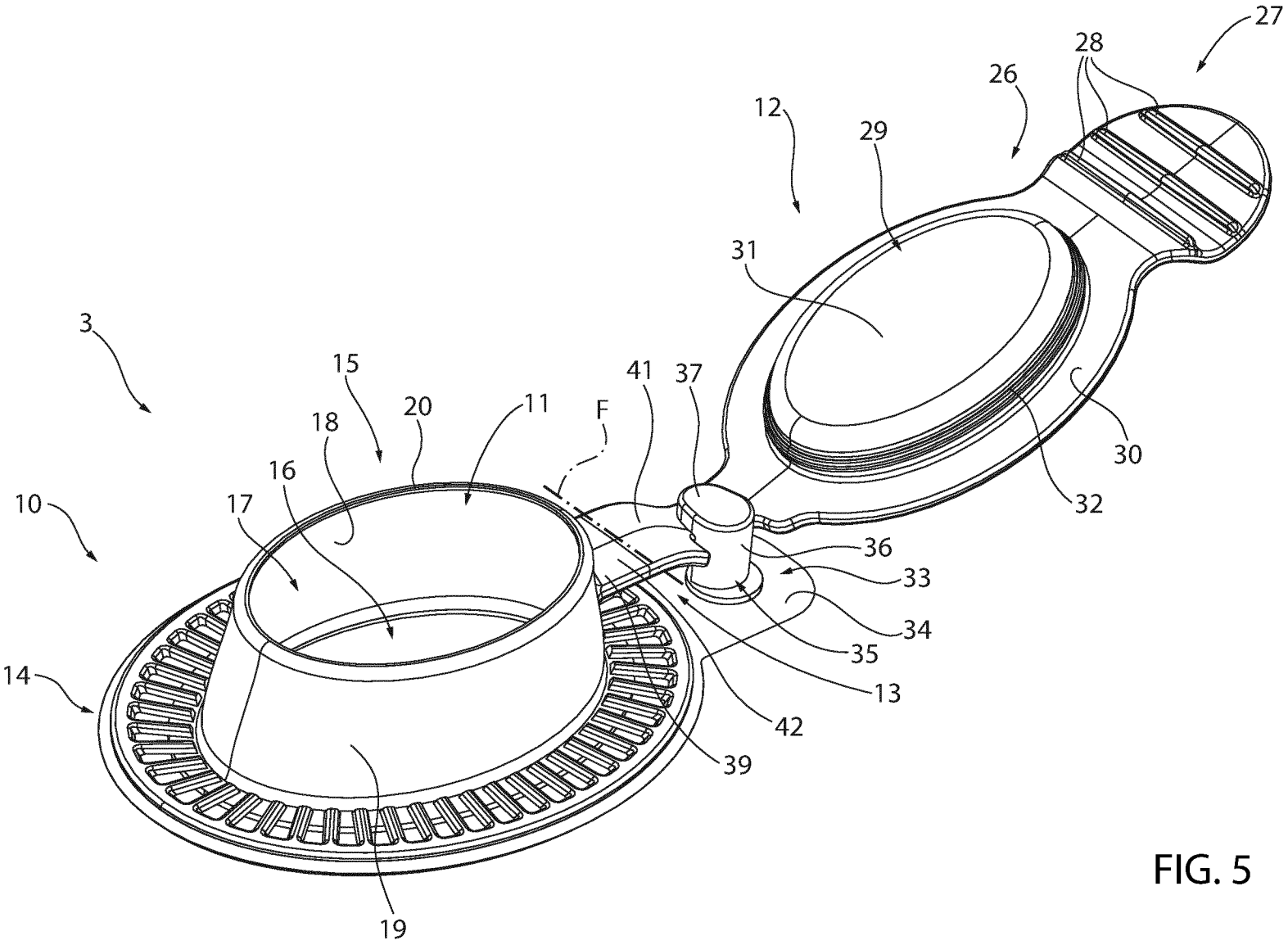
FIG. 5 is an enlarged perspective view of the lid-spout assembly being in the second configuration, with parts removed for clarity.

With particular reference to FIGS. 3 and 4, base frame 14 comprises a first annular portion 24 and a second annular portion 25 axially displaced from one another with respect to longitudinal axis E and configured to interpose and/or interposing a portion of main body 2, in particular second wall portion 6, between one another. In particular, the portion of main body 2, in particular second wall portion 6, is at the designated pour opening.

Preferentially, first annular portion 24 comprises a first engagement surface configured to contact an outer surface of main body 2 and second annular portion 25 comprises a second engagement surface configured to contact an inner surface of main body 2, the inner surface facing inner space 7. In particular, the first engagement surface and the second engagement surface face one another.

According to some preferred non-limiting embodiments, lid 12 is controllable between at least:

a closed position (see FIGS. 1A, 2 and 3) in which lid 12 is configured to cover and/or covers pouring outlet 11, in particular for impeding an outflow of the pourable product out of pouring outlet 11; and an open position (see FIGS. 1B, 4 and 5) in which lid 12 is configured to be and/or is detached from pouring outlet 11, in particular for allowing an outflow of the pourable product through pouring outlet 11.

In particular, lid 12 is configured to close and open the pouring outlet 11 when being respectively in the closed position and the open position.

Preferentially, lid 12 is in a first angular position and in a second angular position with respect to a hinge axis F when being controlled in respectively the closed position and the open position.

It should be noted that package 1 is immediately after its formation in an initial configuration in which lid 12 is in the closed position. Package 1 is distributed and/or sold to a consumer while being in the initial configuration.

According to some preferred non-limiting embodiments, lid 12 comprises at least a main portion 26 configured to at least partially protrude and/or at least partially protruding into flow channel 17, and in particular to seal pouring outlet 11, in particular when being arranged in the closed position.

Preferentially, main portion 26 is shaped like a hat or is hat-like shaped.

Preferentially, lid 12 also comprises a gripping element 27 protruding, in particular laterally protruding, from main portion 26, and in particular being configured to allow the consumer to grip gripping element 27 itself so that the consumer can control lid 12 between the closed position and the open position. In particular, gripping element 27 comprises ribs 28 improving the gripping properties of gripping element 27.

According to some preferred non-limiting embodiments, main portion 26 comprises at least:

a central section 29 at least partially protruding and/or configured to at least partially protrude into flow channel 17, in particular with lid 12 being in the closed position; and a peripheral section 30 connected to and surrounding central section 29 and configured to engage and/or engaging collar 15, in particular first rim 20.

Preferentially, central section 29 comprises at least:

a central wall 31, in particular transversal, even more particular perpendicular, to longitudinal axis E with lid 12 being in the closed position; and a lateral wall 32 fixed to and protruding from central wall 31, and in particular configured to engage inner surface 18 with lid 12 being in the closed position.

In particular, lateral wall 32 is fixed to central wall 31 at a first end of lateral wall 32 itself and to peripheral section 30 at a second end of lateral wall 32 itself.

According to some preferred non-limiting embodiments, central wall 31 is arranged within flow channel 17, in particular between pouring outlet 11 and inlet opening 16, with lid 12 being arranged in the closed configuration.

According to some preferred non-limiting embodiments, lid 12 is rupturably fixed to collar 15, in particular first rim 20, in particular prior to the first time lid 12 is controlled from the closed position to the open position. In particular, lid 12, preferentially main portion 26, even more particular central section 29 and/or peripheral section 30, is rupturably fixed in an irreversible manner to collar 15, in particular first rim 20. Thus, after the first-time control of lid 12 from the closed position to the open position, it is again possible to control lid 12 in the closed position and to establish contact between lid 12 and collar 15, but lid 12 is not fixed to collar 12 anymore.

Preferentially, lid-spout assembly 3 also comprises a coupling membrane, in particular an annular coupling membrane, rupturably connecting lid 12 and collar 15 to one another, in particular prior to the first time lid 12 is controlled from the closed position to the open position.

According to some non-limiting embodiments, lid 12 comprises the coupling membrane.

According to alternative non-limiting embodiments, collar 15 comprises the coupling membrane.

According to alternative non-limiting embodiments, lid 12 and collar 15 each comprises a respective portion of the coupling membrane.

In particular, lid 12 is rupturably fixed to collar 15, in particular by means of the coupling membrane, so as to seal flow channel 17 (and as a consequence inner space 7) from an outer environment.

According to some preferred non-limiting embodiments, lid 12 is bonded and/or welded and/or molded to collar 15 so as to rupturably fix lid 12 to collar 15.

According to some preferred non-limiting embodiments, lid spout-assembly 3 further comprises a retaining group 33 configured to interact with tethering element 13 and/or lid 12 for (at least) temporarily retaining lid 12 in the open position. In particular, "temporarily retaining" means that the interaction is such that tethering element 13 and/or lid 12 can be disengaged from retaining group 33 again.

In particular, tethering element 13 is designed to be (temporarily) coupled to retaining group 33 for retaining lid 12 in the open position.

Preferentially, lid spout-assembly 3 further comprises a connection base 34 fixed to and protruding, in particular laterally protruding away, from base frame 14 and carrying retaining group 33. In particular, connection base 34 is substantially parallel to base frame 14.

In particular, connection base 34 is connected to second annular portion 25, even more particular laterally protrudes from second annular portion 25.

Preferentially, retaining group 33 comprises a hook element 35 configured to interact with tethering element 13 for retaining lid 12 in the open position.

Preferentially, hook element 35 transversally, in particular perpendicularly, extends from connection base 34.

In particular, hook element 35 comprises a support bar 36 being fixed to and transversally, in particular perpendicularly, protruding from connection base 34 and a hook 37 transversally protruding from support bar 36.

According to the specific embodiment disclosed, hook 37 extends (substantially) parallel to hinge axis F and/or base frame 14 and/or outer surface 19.

Alternatively, or in addition, hook 37 could extend away and/or towards outer surface 19 and/or base frame 14.

According to some preferred non-limiting embodiments, lid-spout assembly 3, in particular spout 10, lid 12 and tethering element 13, even more particular also retaining group 33, is/are formed in a single piece.

According to some preferred non-limiting embodiments, lid-spout assembly 3, in particular spout 10, lid 12 and tethering element 13, even more particular also retaining group 33, is/are formed and/or molded, in particular simultaneously molded, from a polymer and preferentially in a single piece. In particular, lid-spout assembly 3 is directly molded on the packaging material about the designated pour opening.

Advantageously, tethering element 13 comprises a first end 38 fixed to lid 12 and a second end 39, in particular opposite to first end 38, fixed to collar 15.

Preferentially, tethering element 13 is fixed to outer surface 19.

Even more preferentially, tethering element 13 is fixed to a central portion 40 of collar 15.

According to some preferred non-limiting embodiments, first end 38 is connected to main portion 26, in particular peripheral section 30. In particular, first end 38 is connected to a first zone of main portion 26, in particular peripheral section 30, and gripping element 27 is connected to a second zone of main portion 26, in particular peripheral section 30. Preferentially, the first zone is opposite to the second zone.

According to some preferred non-limiting embodiments, tethering element 13 presents a (substantially) two-dimensional shape, in particular such that when being non-stressed tethering element 13 extends along a respective longitudinal axis and a second axis transversal to the longitudinal axis. In particular, an extension of tethering element 13 along the longitudinal axis is larger than an extension of tethering element 13 along the second axis. Even more particular, an extension along a third axis transversal to the longitudinal axis and the second axis is negligible and/or smaller with respect to the corresponding extensions along the longitudinal axis and the second axis.

According to some preferred non-limiting embodiments, tethering element 13 is bendable and/or flexible and/or deflectable.

Preferentially, tethering element 13 is configured to modify its shape in dependence of the position of lid 12.

Preferentially, tethering element 13 is controllable between at least a first configuration with lid 12 being in the closed position and a second configuration (distinct from the first configuration) with lid 12 being in the open configuration.

According to some preferred non-limiting embodiments, tethering element 13 comprises a bendable portion 41 configured to modify its shape in dependence of the position of lid 12. In particular, bendable portion 41 is configured to modify its shape during control of lid 12 between the closed position and the open position (and accordingly of tethering element 13 between the first configuration and the second configuration).

Preferentially, tethering element 13 also comprises a first straight portion 42 having second end 39, and in particular being fixed in shape. In particular, first straight portion 42 is connected to bendable portion 41 and transversally protrudes from outer surface 19. Even more preferentially, straight portion 42 is perpendicular to longitudinal axis E.

Even more preferentially, first straight portion 42 defines hinge axis F.

Preferably, first straight portion 42 transversally (and laterally), in particular perpendicularly (and laterally) protrudes, from collar 15.

Preferably, first straight portion 42 extends (substantially) parallel to base frame 14 and/or second wall portion 6, in particular irrespective of whether lid 12 is in the closed position or the open position.

Preferentially, tethering element 13 also comprises a second straight portion 43 having first end 38, and in particular being fixed in shape. In particular, second straight portion 43 is connected to bendable portion 41 and transversally, in particular perpendicularly, protrudes from lid 12, in particular main portion 26, even more particular peripheral section 30.

Preferentially, second straight portion 43 is (substantially) parallel to base frame 14 and/or second wall portion 6 with lid 12 being in the open configuration (and in particular with lid 12 and/or tethering element 13 interacting with retaining group 33).

In the present context, substantially parallel means that second straight portion 43 may deviate from a perfect parallel alignment. However, the angle between second straight portion 43 and base frame 14 and/or second wall portion 6 (considering appropriate imaginary extensions) is negligible.

Preferentially, bendable portion 41 is interposed between first straight portion 42 and second straight portion 43.

According to some preferred non-limiting embodiments, tethering element 13, in particular bendable portion 41, presents a curved shape, in particular a curved U-shape, when being in the first configuration and/or with lid 12 being in the closed configuration.

Preferentially, tethering element 13, in particular bendable portion 41 presents a S-shape with lid 12 being in the open configuration (and in particular with lid 12 and/or tethering element 13 interacting with retaining group 33).

According to some preferred non-limiting embodiments, tethering element 13 comprises a recess 44 configured to engage retaining group 33, in particular hook element 35, so as to (at least) temporarily fix lid 12 in the open position.

In particular, recess 44 is designed such that tethering element 13 engages a portion of support bar 36 and a portion of hook 37 for retaining lid 12 in the open configuration.

Preferentially, recess 44 is delimited by a main surface and two auxiliary surfaces spaced apart from one another and being transversal, in particular perpendicular, to main surface. In particular, auxiliary surfaces are designed such to interpose a portion of support bar 36 between one another with tethering element 13 being coupled to retaining group 33.

Preferentially, hook element 35, in particular hook 37, comprises an abutment surface, in particular facing main body 2, in particular second wall portion 6, and tethering element 13 is configured to abut against the abutment surface when being coupled to retaining group 33.

In use, the outpouring of the pourable product from package 1 requires controlling lid 12 from the closed position to the open position so as to open pouring outlet 11.

The first time lid 12 is controlled from the closed position to the open position, lid 12 is detached from collar 15 so that the next time lid 12 is again arranged in the closed position, lid 12 is only connected to collar 15, but not fixed thereto.

When lid 12 is controlled in the open position, tethering element 13 is coupled to retaining group 33 so that lid 12 remains in the open position.

After the termination of the outpouring, lid 12 is positioned again in the closed position.

Tethering element 13 guarantees that lid 12 remains coupled to spout 10, in particular collar 15, in particular even in the case an unusual force is executed on tethering element 13.

The advantages of lid-spout assembly 3 and/or of package 1 according to the present invention will be clear from the foregoing description.

In particular, by fixing tethering element 13 on collar 15 it is possible to improve the resistance of tethering element 13 to any forces acting on tethering element 13. In other words, any unwanted or wanted detachment of tethering element 13 from spout 10, in particular collar 15, is rendered even more unlikely.

A further advantage resides in that the molding process is facilitated due to tethering element 13 being fixed to collar 15.

Another advantage is seen in that tethering element 13 is less stressed when moving lid 12 from the closed position to the open position in comparison with the known solutions.

Furthermore, retaining lid 12 in the open position is easier due to the fact that tethering element 13 is less stressed.

An even other advantage is that the movement of lid 12 from the closed position to the open position is facilitated.

Another advantage resides in providing for retaining group 33 so as to ensure that lid 12 does not interfere with the outflow of the pourable product when being in the open configuration. Retaining group 33 allows to fix lid 12 in position during the outpouring action.

An even other advantage can be seen in providing for recess 44 further improving the retaining of lid 12 in the open configuration.

Clearly, changes may be made to lid-spout assembly 3 and/or package 1 as described herein without, however, departing from the scope of protection as defined in the accompanying claims.

The invention claimed is:

1. A lid-spout assembly for a package having a main body comprising a designated pour opening and being filled with a pourable product;

the lid-spout assembly comprises at least:

a spout having a pouring outlet;

a lid configured to selectively close and open the pouring outlet;

a tethering element tethering the lid to the spout, wherein the tethering element does not block the spout when the lid is in the closed position; and a retaining group configured to contact at least one of the tethering element or the lid, such that the contact at least temporarily holds the lid in the open position;

a connection base;

wherein the spout comprises at least:

a base frame configured to couple the spout to the main body about the designated pour opening; and a collar carrying the pouring outlet and protruding from the base frame;

wherein the connection base is fixed to and protruding from the base frame and the connection base is integral with the retaining group;

wherein the collar includes a central portion located below a rim of the collar; and wherein the tethering element comprises a first end fixed to the lid and a second end fixed to the central portion of the collar.

2. The lid-spout assembly according to claim 1, wherein the collar comprises an inner surface delimiting a flow channel for the pourable product and an outer surface opposite to the inner channel;

wherein the second end is fixed to the outer surface.

3. The lid-spout assembly according to claim 1, wherein the lid is rupturably fixed to the collar.

4. The lid-spout assembly according to claim 1, wherein the lid comprises at least a main portion configured to at least partially protrude into the flow channel.

5. The lid-spout assembly according to claim 4, wherein the lid comprises a gripping element protruding from the main portion.

6. The lid-spout assembly according to claim 4, wherein the main portion comprises at least a central section at least partially protruding into the flow channel and a peripheral section connected to and surrounding the central section and configured to engage and/or engaging a rim of the collar delimiting the pouring outlet.

7. The lid-spout assembly according to claim 1, wherein the lid is controllable between at least:

a closed position in which the lid covers the pouring outlet; and an open position in which the lid is configured to open the pouring outlet.

8. The lid-spout assembly according to claim 7, wherein the tethering element is controllable between a first configuration and a second configuration with the lid being controlled in respectively the closed position and the open position.

9. The lid-spout assembly according to claim 8, wherein the tethering element is curved when being in the first configuration.

10. The lid-spout assembly according to claim 8, wherein the tethering element is U-shaped when being in the first configuration and/or is S-shaped when being in the second configuration.

11. The lid-spout assembly according to claim 1, wherein the retaining group comprises a hook element configured to contact the tethering element to at least temporarily hold the lid in the open position.

12. The lid-spout assembly according to claim 1, wherein the tethering element comprises a recess configured to contact the retaining group so as to at least temporarily fix the lid in the open position.

13. The lid-spout assembly according to claim 1, wherein the spout, the lid and the tethering element are formed in a single piece.

14. A package comprising a main body filled with a pourable product and at least one lid-spout assembly according to claim 1 and coupled to the main body.

15. A package according to claim 14, wherein the main body is formed from a multilayer composite packaging material.

* * * * *